US006222574B1

(12) United States Patent
Nakanishi

(10) Patent No.: US 6,222,574 B1
(45) Date of Patent: Apr. 24, 2001

(54) THERMAL PRINTING HEAD

(75) Inventor: Masatoshi Nakanishi, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 09/381,691

(22) PCT Filed: Mar. 31, 1998

(86) PCT No.: PCT/JP98/01496

§ 371 Date: Sep. 22, 1999

§ 102(e) Date: Sep. 22, 1999

(87) PCT Pub. No.: WO98/43819

PCT Pub. Date: Oct. 8, 1998

(30) Foreign Application Priority Data

Mar. 31, 1997 (JP) ..... 9-080602

(51) Int. Cl.[7] ..... B41J 2/335; B41J 2/34

(52) U.S. Cl. ..... 347/209

(58) Field of Search ..... 347/208, 211, 347/209, 210

(56) References Cited

FOREIGN PATENT DOCUMENTS 61-239957 10/1986 (JP) .

OTHER PUBLICATIONS

International Search Report for International application No. PCT/JP98/01496 Jun. 30, 1998.

*Primary Examiner*—Huan Tran

(74) *Attorney, Agent, or Firm*—Merchant & Gould P.C.

(57) ABSTRACT

A thermal printhead includes plural groups of drive ICs (DrIC1–14), a plurality of main conductor wirings (31–34) for transmitting signals to the drive ICs in the respective groups, and a plurality of auxiliary conductor wirings (41–43) respectively provided to accompany the main conductor wirings for providing conduction between the drive ICs in adjacent groups. The main conductor wirings and the auxiliary conductor wirings respectively include severable sites (a–f) for severing electrical conduction of the main conductor wirings and the auxiliary conductor wirings. A plurality of recovery wiring portions (32*a*–34*a* and 41*a*–43*a*) are provided to the respective severable sites in parallel thereto. Each of the recovery wiring portions includes a pair of pads spaced from each other.

7 Claims, 3 Drawing Sheets

THERMAL PRINTING HEAD

TECHNICAL FIELD

The present invention relates to a thermal printhead for forming images on thermosensitive paper or on recording paper via a thermal-transfer ink ribbon.

BACKGROUND ART

As is well known, thermal printheads are used for forming intended images by selectively providing thermal energy to thermosensitive paper or a thermal-transfer ink ribbon. Generally, thermal printheads are divided mainly into thin film-type thermal printheads and thick film-type thermal printheads depending on methods of forming their heating resistors. As an example, a typical thick film-type thermal printhead will be described below.

FIG. 1 shows a conventionally used thick film-type thermal printhead 1. As will be described later, a thermal printhead according to the present invention has a structure similar to that shown in FIG. 1 except for its characteristic portions.

The thermal printhead 1 shown in FIG. 1 includes a head substrate 11 formed of alumina ceramic and an additional substrate 20 formed of glass-fiber-reinforced epoxy resin. The head substrate 11 is provided with a linear heating resistor 12, a plurality of drive ICs 13, a common electrode 14 and a plurality of individual electrodes 15. The heating resistor 12 extends longitudinally of the head substrate. The drive ICs 13 are arranged in a row extending in the longitudinal direction of the head substrate.

The common electrode 14 is integrally formed with a plurality of comb-teeth like projections 16 extending parallel to each other. Each projection 16 has a free end electrically connected to the heating resistor 12. Each individual electrode 15 is linear and has two free ends. As shown in FIG. 1, the individual electrodes 15 and the plurality of projections 16 are alternately disposed. One free end of each individual electrode 15 is positioned between two adjacent projections 16 of the common electrode 14 to be electrically connected to the heating resistor 12, whereas the other free end is connected, via a conductive wire 19, to an output pad (not shown) of a relevant drive IC 13. With such an arrangement, the heating resistor 12 includes a plurality of regions 18 each defined between two adjacent projections 16. These regions function as heating dots under the control of the drive ICs 13. Specifically, a current is supplied to the region 18 selected by the drive ICs 13 via the adjacent projection 16 and the individual electrode 15. As a result, the selected region is heated up to function as a heating dot.

The additional substrate 20 is formed with a wiring pattern (partially shown) which is connected to input pads (not shown) of the drive ICs 13 via a plurality of conductive wires 19*a*. The additional substrate 20 is further provided with a connector 17 connected to the wiring pattern. The connector 17 is also connected to a cable (not shown) for transmitting signals supplied from outside. With the above arrangement, the external signals are transmitted via the wiring pattern to the drive ICs 13. The drive ICs 13 will operate based on the thus transmitted signals.

Each of the drive ICs 13 incorporates a shift register which has a predetermined number of bits corresponding to the number of the output pads of the drive IC 13. The drive ICs 13 have their data-out terminals connected in cascade to their data-interminals, so that the shift registers in the respective drive ICs 13 are connected to each other.

The thermal printhead having the above structure operates as follows. In order to perform printing for one line, printing data for the line need be input to the drive ICs 13 in advance. To this end, the printing data for the line are serially fed to the leftmost drive IC 13 shown in FIG. 1 via the data-in terminal. Then, the printing data are successively fed to the shift registers of the respective drive ICs 13 connected in cascade to each other, and retained in them. In accordance with the retained printing data, the output pads of the drive ICs 13 are selectively actuated in synchronism with a strobe signal fed to each drive IC 13. As a result, the heating dots 18 are selectively heated up for performing a predetermined printing operation.

Unfavorably, the thermal printhead 1 having the above arrangement has the following problems. Since the printing data for one line are serially fed to the drive ICs 13, the printing operation for the line cannot be started until the input of the serial data is completed. This means that, in the above thermal printhead, it is impossible to improve the printing speed beyond a certain limit due to the serial data input. Further, when all the heating dots 18 are actuated simultaneously, an increased amount of current will pass through the common electrode 14. Consequently, the voltage drop along the common electrode 14 is intensified, which leads to uneven printing results.

To deal with the above problems, the following measures have conventionally been taken. To begin with, printing data for one line are divided into a predetermined number of pieces, while the drive ICs 13 are also divided into the same number of groups. Then, each piece of the divided printing data is simultaneously fed to a corresponding one of the groups of the drive ICs 13. Compared with the serial input described above, this method is advantageous in that the printing data can be fed to the drive ICs 13 more quickly, so that the printing speed is improved. In addition, by staggering the timing of driving the respective groups of drive ICs 13, the current flowing through the common electrode 14 will be decreased, thereby reducing the voltage drop along the common electrode 14.

However, the above method suffers the following problem. To feed the divided data to the respective groups of drive ICs 13, a special wiring pattern designed for that particular purpose is needed. Therefore, it is necessary to prepare different kinds of wiring patterns, such as a wiring pattern suitable for the use of two-grouped printing data or a wiring pattern suitable for the use of three-grouped printing data, depending on the characteristics of a device in which the thermal printhead 1 is incorporated or on the need of a user. To individually manufacture such thermal printheads having different kinds of wiring patterns requires additional time and trouble, thereby leading to an increase in cost. Further, in order to actuate the drive ICs 13 group by group with time difference, a wiring pattern for supplying strobe signals needs to be additionally designed in accordance with the particular divisional manner.

Moreover, the design of the various wiring patterns mentioned above may need to be altered after they are produced. For instance, a user may wish to use a wiring pattern designed for three-grouped printing data in place of the originally used wiring pattern designed for two-grouped printing data. Conventionally, in such a situation, a thermal printhead incorporating a wiring pattern designed for three-grouped printing data may need to be purchased additionally, which is very inconvenient.

DISCLOSURE OF THE INVENTION

Therefore, it is an object of the present invention to provide a thermal printhead which is capable of solving the above problems.

In accordance with the present invention, there is provided a thermal printhead comprising:

drive ICs divided into a plurality of groups;

a plurality of main conductor wirings for transmitting signals to the respective groups of the drive ICs; and a plurality of auxiliary conductor wirings arranged to accompany the main conductor wirings, respectively, for connecting the drive ICs in adjacent groups;

wherein each main conductor wiring and each auxiliary conductor wiring include a severable site for severing electrical conduction of said each main conductor wiring and said each auxiliary conductor wiring.

In the thermal printhead having the above arrangement, a selected one of the severable site of said each main conductor wiring and the severable site of the auxiliary conductor wiring accompanying said each main conductor wiring may be severed.

Further, all the severable sites of the main conductor wirings maybe severed. Still further, all the severable sites of the auxiliary conductor wirings may be severed.

Each of the severable sites may be formed with a marking.

Preferably, the thermal printhead may further comprise a plurality of recovery wiring portions arranged in parallel to the severable sites, respectively. Each recovery wiring portion may include a pair of pads spaced from each other.

Various features and advantages of the present invention will become clearer from the description given below with reference to the accompanying drawings.

BEST MODE FOR CARRYING OUT THE INVENTION

Figure 1:
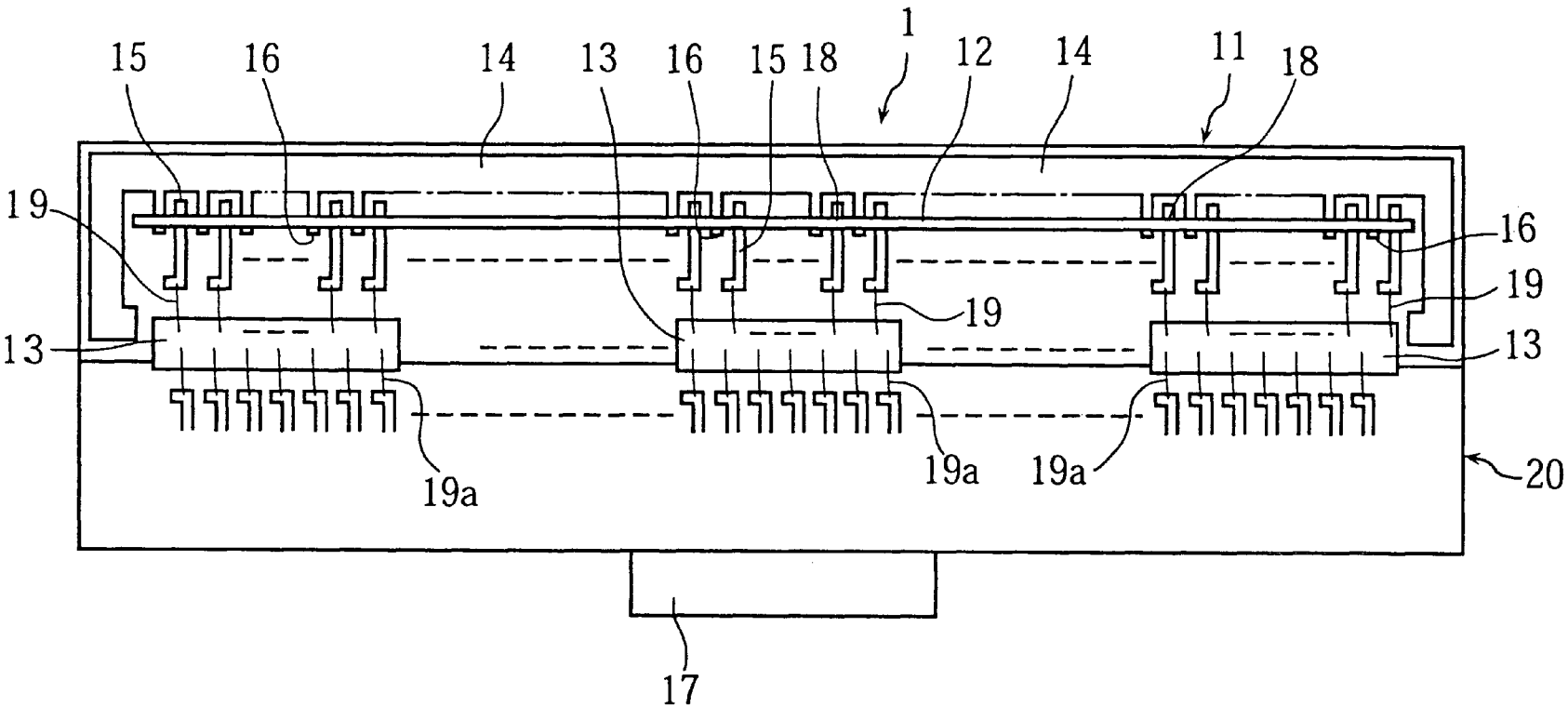
FIG. 1 is a plan view showing arrangements of a thermal printhead which are common to the prior art and the present invention.

As previously described, a thermal printhead according to the present invention has a structure substantially the same as that of the conventional thermal printhead shown in FIG. 1. Therefore, the thermal printhead according to the present invention will also be described with reference to FIG. 1 (and other figures).

Specifically, the thermal printhead 1 according to the present invention includes a head substrate 11 formed of e.g., alumina ceramic, and an additional substrate 20 formed of e.g., glass-fiber-reinforced epoxy resin. The head substrate 11 is provided with a linear heating resistor 12, a plurality of drive ICs 13, a common electrode 14 and a plurality of individual electrodes 15. The heating resistor 12 extends longitudinally of the head substrate. The drive ICs 13 are linearly disposed in the longitudinal direction of the head substrate.

The common electrode 14 is integrally formed with a plurality of comb-teeth like projections 16 extending parallel to each other. Each projection 16 has a free end electrically connected to the heating resistor 12. Each individual electrode 15 has an elongated configuration and has two free ends. As shown in FIG. 1, the individual electrodes 15 and the plurality of projections 16 are alternately disposed. One free end of each individual electrode 15 is positioned between two adjacent projections 16 of the common electrode 14 to be electrically connected to the heating resistor 12. On the other hand, the other free end of the individual electrode 15 is connected, via a conductive wire 19 such as a gold wire, to an output pad (not shown) of a relevant drive IC 13. Each of the drive ICs 13 is provided with power and signal pads (not shown). Further each drive IC 13 incorporates a shift register. The shift register has a predetermined number of bits corresponding in number to the output pads of the drive IC 13.

With the above arrangement, the heating resistor 12 includes a plurality of regions 18 (See FIG. 1) each of which is defined by adjacent projections 16. The respective regions operate as heating dots under control of the drive ICs 13. More specifically, a current is supplied to the region 18 selected by the drive ICs 13, via the adjacent projection 16 and the individual electrode 15. As a result, the particular region is heated up to function as a heating dot.

The additional substrate 20 carries a connector 17. This connector 17 is arranged to be connected to a cable (not shown) which is used for transmitting signals supplied from outside. The additional substrate 20 is further formed with a wiring pattern which is connected to e.g., the signal pads of the drive ICs 13 via wires 19*a*.

Figure 2:
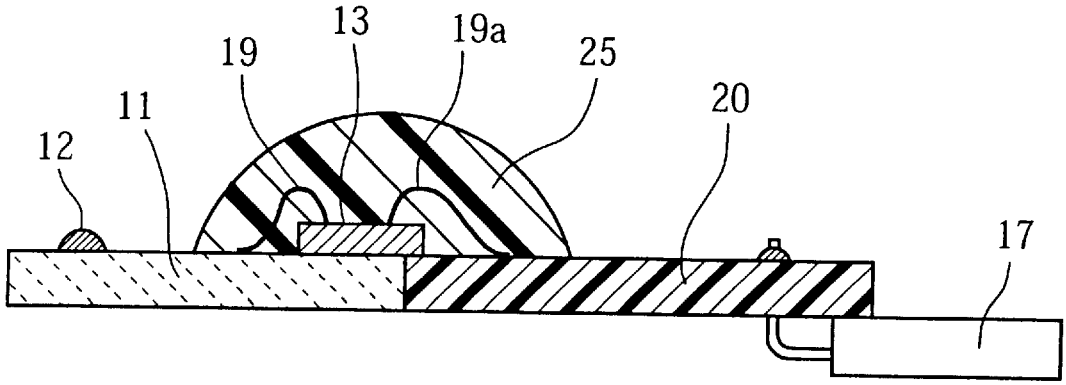
FIG. 2 is a sectional view showing the same thermal printhead.

As shown in FIG. 2, the drive IC 13, the bonding wires 19, 19*a* are covered with a protective coating 25 formed of e.g., a hard coating material.

Figure 3:
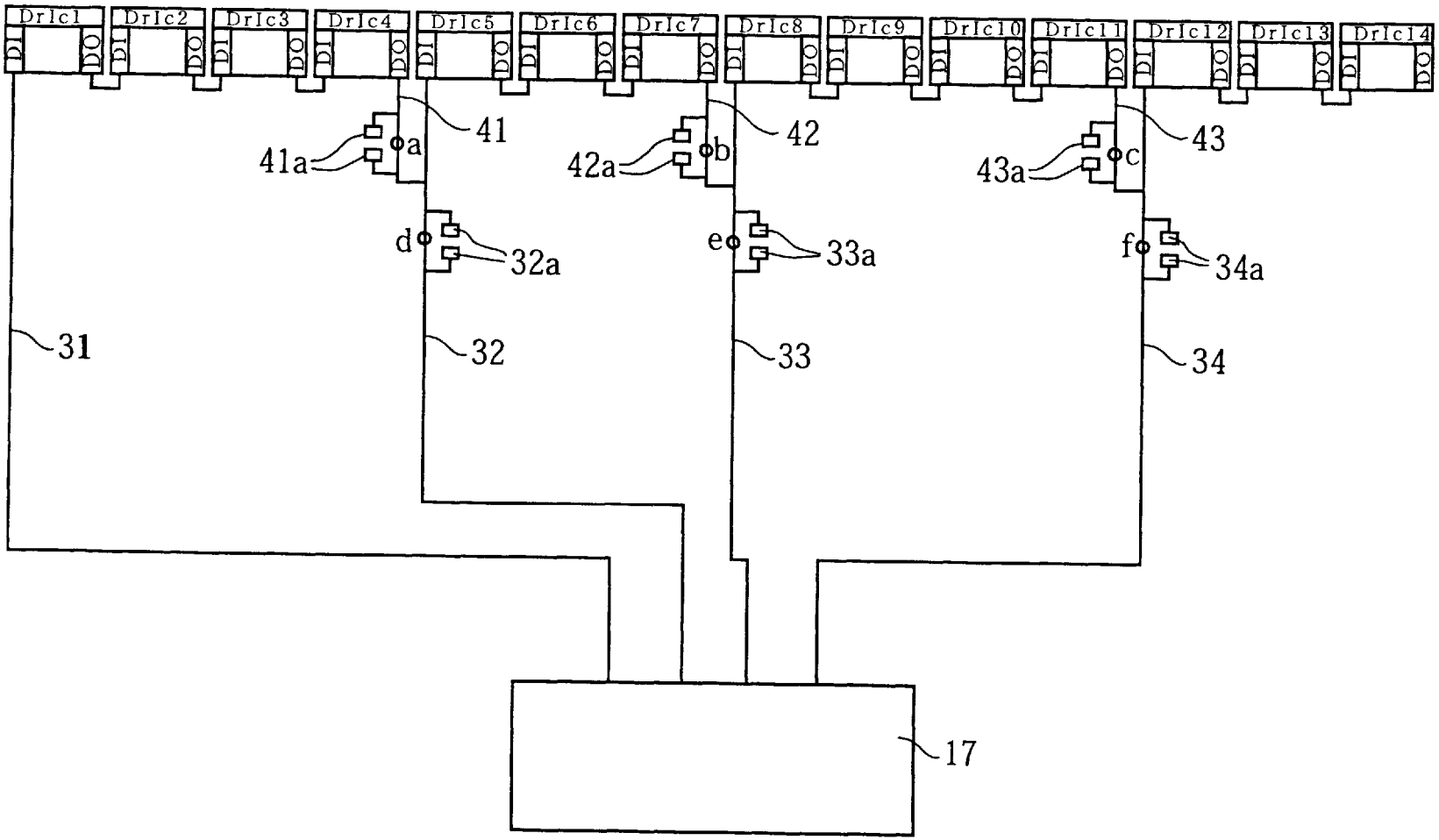
FIG. 3 is a schematic view showing a wiring pattern for the printing data according to the present invention.

The most significant feature of the present invention is the wiring pattern formed on the head substrate 20. This wiring pattern will be described below with reference to FIG. 3.

The illustrated wiring pattern is designed so that printing data for one line supplied via the connector 17 are transmitted to the drive ICs 13 in a manner which permits the printing data to be divided in to a maximum of four groups. Specifically, the fourteen drive ICs 13 are divided into four groups. The first group includes four drive ICs (DrIC1–4), the second group three drive ICs (DrIC5–7), the third group four drive ICs (DrIC8–11), and the fourth group three drive ICs (DrIC12–14). In each group, the drive ICs are electrically connected to each other.

The illustrated wiring pattern includes four main conductor wirings 31–34 and three auxiliary conductor wirings 41–43. One ends of the respective main conductor wirings 31–34 are connected to the connector 17. The other ends of the main conductor wirings 31–34 are connected, respectively, to the data-in pad (DI) of the drive IC (DrIC1), the data-in pad (DI) of the drive IC (DrIC5), the data-in pad (DI) of the drive IC (DrIC8), and the data-in pad (DI) of the drive IC (DrIC12). The three auxiliary conductor wirings 41–43 are arranged to connect, respectively, the data-out pad (DO) of the drive IC (DrIC4) to the data-in pad (DI) of the drive IC (DrIC5), the data-out pad (DO) of the drive IC (DrIC7) to the data-in pad (DI) of the drive IC (DrIC8), and the data-out pad (DO) of the drive IC (DrIC11) to the data-in pad (DI) of the drive IC (DrIC12).

The main conductor wirings 32–34 are provided with severable sites d–f respectively for severing electrical conduction of the main conductor wirings. The severable sites may be provided with predetermined markings for facilitating visual recognition. Similarly, the auxiliary conductor wirings 41–43 are provided with severable sites a–c respectively for severing electrical conduction of the auxiliary conductor wirings. The severable sites may also be provided with predetermined markings.

Further, the main conductor wirings 32–34 are provided with recovery wiring portions 32*a*–34*a*, respectively, each of which extends so as to bridge a corresponding one of the severable sites d–f. Each of the recovery wiring portions includes two spaced pads and conductor wirings for connecting the respective pads to the main conductor wiring. Similarly, the auxiliary conductor wirings 41–43 are provided with recovery wiring portions 41*a*–43*a*, respectively, each of which extends to bridge a corresponding one of the severable sites a–c. Each of the recovery wiring portions includes two spaced pads and conductor wirings for connecting the respective pads to the auxiliary conductor wiring. Each severable site may be bypassed by connecting the two spaced pads of the recovery wiring portion by soldering or wire-bonding.

The wiring pattern thus formed may be utilized as follows. It should be noted that, in the description given below, all the severable portions a–f are depicted as being connected in the initial state.

It is now supposed that the one-line printing data divided into four groups are to be supplied to the drive ICs. In this case, the severable portions a, b and c shown in FIG. 3 will be severed by etching or NC machining for example. In this manner, a piece of printing data supplied through the main conductor wiring 31 is transmitted from the leftmost drive IC (DrIC1) to the rightmost drive IC (DrIC4) of the first group. Similarly, a piece of printing data supplied through the main conductor wiring 32 is transmitted from the leftmost drive IC (DrIC5) to the rightmost drive IC (DrIC7) of the second group, a piece of printing data supplied through the main conductor wiring 33 is transmitted from the leftmost drive IC (DrIC8) to the rightmost drive IC (DrIC11) of the third group, and a piece of printing data supplied through the main conductor wiring 34 is transmitted from the leftmost drive IC (DrIC12) to the rightmost drive IC (DrIC14) of the fourth group.

Now, it is supposed that the one-line printing data are to be divided into two groups for supply to the drive ICs. In this case, the severable portions b, d and f are severed, as may easily be understood. Alternatively, when the whole one-line printing data are serially transmitted in one group, the severable portions d, e and f are severed.

Once the severable portions a, b and c have been severed for enabling four-group transmission of the printing data, the wiring pattern can be altered into the two division form in the following manner. First, the severable portions d and f are severed. Then, the recovery wiring portions 41*a*, 43*a* are electrically connected. As a result, the wiring pattern is modified so that the one-line printing data divided into two groups will be transmitted to the drive ICs.

In the thermal printhead 1 of the present invention, as is clear from the above, a single wiring pattern can be modified to a selected one of the one-division, two-division and four-division patterns, as required, in the above-described manner. Thus, it is possible to provide various kinds of divisional patterns without individually preparing the wiring patterns corresponding to the respective divisions. Therefore, in the thermal printhead 1 formed with the wiring pattern described above, by severing the main conductor wiring or the auxiliary conductor wiring, the drive ICs may be divided into a desired number of groups in accordance with the order from a user for example. Thus, the time and trouble taken for designing can be reduced.

Further, when the main conductor wiring and the auxiliary conductor wiring are to be severed by using a NC machining technique, it suffices to prepare a new program for controlling the movement of the processing head of the device performing the NC machining. This requires less time and trouble than the additional designing of a plurality of wiring patterns.

Further, as described above, it is possible to reconnect the once severed auxiliary conductor wirings 41, 42, 43 by connecting the recovery wiring portions 41*a*, 42*b* and 43*c*. This means that the divisional number once determined can be altered. It is clear that the similar operation can be performed with respect to the main conductor wirings 32–34 provided with the recovery wiring portions 32*a*–34*a*.

In the above embodiment, the drive ICs 13 are divided into four groups. However, it is obvious that the drive ICs 13 may be divided into another number of groups.

Further, in the above embodiment, the main conductor wirings and the auxiliary conductor wirings are described as being initially connected at the severable portions. Alternatively, all the severable portions may be severed in the initial state. Even in this case, it is possible to achieve a desired number of division by connecting the spaced pads of the recovery wiring portions. It may also be possible to have only one selected severable portion severed in the initial state.

In the above embodiment, the wiring pattern for transmitting printing data is described. The present invention, however, may be applied to a wiring pattern for transmitting clock signals, strobe signals, or strobe clock signals.

Further, in the above embodiment, the wiring pattern and the drive ICs are mounted on separate substrates 10 and 11, respectively. However, the wiring pattern and the drive ICs may be mounted on a common substrate.

The present invention is applied to a thick film-type thermal printhead in the above embodiment. However, the present invention may also be applied to a thin film-type thermal printhead.

INDUSTRIAL APPLICABILITY

As described hereinbefore, the thermal printhead according to the present invention may advantageously be used based on one-line printing data or the like which may be divided into plural pieces.

What is claimed is:

1. A thermal printhead comprising:

drive ICs divided into a plurality of groups;

a plurality of main conductor wirings for transmitting signals to the respective groups of the drive ICs; and a plurality of auxiliary conductor wirings arranged to accompany selected ones of the main conductor wirings, respectively, for connecting the drive ICs in adjacent groups;

wherein each selected main conductor wiring and the auxiliary conductor wiring accompanying said each selected main conductor wiring are directly connected to each other, said each selected main conductor wiring and each auxiliary conductor wiring being formed with a severable site for severing electrical conduction of said each selected main conductor wiring and said each auxiliary conductor wiring.

2. The thermal printhead according to claim 1, wherein a selected one of the severable site of said each selected main conductor wiring and the severable site of the auxiliary conductor wiring accompanying said each selected main conductor wiring is severed.

3. The thermal printhead according to claim 1, wherein all the severable sites of the selected main conductor wirings are severed.

4. The thermal printhead according to claim 1, wherein all the severable site of the auxiliary conductor wirings are severed.

5. The thermal printhead according to claim 1, wherein each of the severable sites is formed with a marking.

6. The thermal printhead according to claim 1, further comprising a plurality of recovery wiring portions arranged in parallel to the severable sites, respectively.

7. The thermal printhead according to claim 6, wherein each recovery wiring portion includes a pair of pads spaced from each other.

* * * * *